US005675996A

United States Patent [19]

Cho

[11] Patent Number: 5,675,996

[45] Date of Patent: Oct. 14, 1997

[54] AGITATOR FOR A CLOTHES WASHER HAVING A VERTICALLY RECIPROCABLE ROD, DRIVEN BY AN INERTIA BODY

[75] Inventor: Sung Won Cho, Suwon, Rep. of Korea

[73] Assignee: Samsung Electronics Co., Ltd., Suwon, Rep. of Korea

[21] Appl. No.: 630,577

[22] Filed: Apr. 11, 1996

[30] Foreign Application Priority Data

Apr. 26, 1995 [KR] Rep. of Korea ..... 1995-9981

[51] Int. Cl.[6] ..... D06F 17/10

[52] U.S. Cl. ..... 68/134

[58] Field of Search ..... 68/53, 133, 134

[56] References Cited

U.S. PATENT DOCUMENTS 5,473,915 12/1995 Hur et al. ..... 68/134

FOREIGN PATENT DOCUMENTS

91/22195 3/1991 Japan .

*Primary Examiner*—Philip R. Coe

*Attorney, Agent, or Firm*—Burns, Doane, Swecker & Mathis, L.L.P.

[57] ABSTRACT

A clothes washing machine includes a water container, a washing basket rotatably mounted in the water container, and an agitator oscillatable at a bottom of the washing basket. The agitator includes a pulsator plate oscillatable about an axis, and a pulsator rod composed of telescoping members mounted at a center of the pulsator plate for upward extension and downward retraction along the axis during the oscillation of the pulsator plate. The pulsator rod is driven by an inertia body mounted on the pulsator plate such that rotation of the pulsator plate relative to the inertia body in one direction causes the pulsator rod to be retracted downwardly. A spring extends the pulsator rod upwardly during rotation of the pulsator plate in the opposite direction.

8 Claims, 5 Drawing Sheets

AGITATOR FOR A CLOTHES WASHER HAVING A VERTICALLY RECIPROCABLE ROD, DRIVEN BY AN INERTIA BODY

RELATED INVENTION

This invention is related to that disclosed in U.S. Ser. No. 08/630,328 filed Apr. 10, 1996.

BACKGROUND OF THE INVENTION

The present invention concerns an agitator for agitating water and clothes in a clothes washing machine which comprises a water container enclosed in a housing for holding water, a washing basket mounted in the water container for holding clothes, an agitator mounted on the bottom of the washing basket for agitating water and clothes, and a motor for rotating the agitator and the washing basket in alternate directions.

Referring to FIG. 7, a conventional washing machine comprises a water container 20 enclosed in a housing 10 for containing water, a drive means 30 mounted beneath the water container 20, a washing basket 60 mounted in the water container 20 for holding clothes, an agitator 70 mounted on the bottom of the washing basket 60 for agitating the water and the clothes, and a power transfer device 50 mounted centrally beneath the water container 20 for transferring the power of the drive means 30 via a belt 40 to the washing basket 60 and the agitator 70.

The agitator 70 includes, as shown in FIG. 8, a body 71, a plurality of blades 72 formed integrally on the body at a given spacing from one another for stirring the water and the clothes, and a cap projection 73 with an inclined top end arranged eccentrically with respect to a central shaft 52 of the agitator 70 for preventing regular water flows from being formed when the body 71 rotates in alternate directions.

In spite of such structure to prevent the regular water flows, the conventional washing machine forms regular water flows by the rotation in alternate directions of the agitator, so that the clothes are twisted or entangled, causing the washing efficiency to be degraded.

SUMMARY OF THE INVENTION

It is an object of the present invention to provide a clothes washing machine with a means for perturbing the water flows in the washing machine, beating the washed clothes, and preventing twisting or entangling of the clothes.

According to an embodiment of the present invention, a clothes washing machine comprises a water container, a washing basket rotatably mounted in the water container, an agitator mounted on the inside of the bottom of the washing basket to rotate in alternate directions, and a rotating shaft for rotating the washing basket and the agitator. The agitator includes a pulsator plate rotated by the rotating shaft, an inertial rotating body rotatably mounted in the pulsator plate, a pulsator rod projected upwards through the pulsator plate, a compression spring arranged between the pulsator plate and the pulsator rod for pushing upwards the pulsator rod, and a connecting means for extending or collapsing the pulsator rod according to the movement of the inertial rotating body.

BRIEF DESCRIPTION OF THE DRAWING

The present invention will now be described more specifically with reference to the drawings attached only by way of example.

DETAILED DESCRIPTION OF A PREFERRED EMBODIMENT

Figure 1:
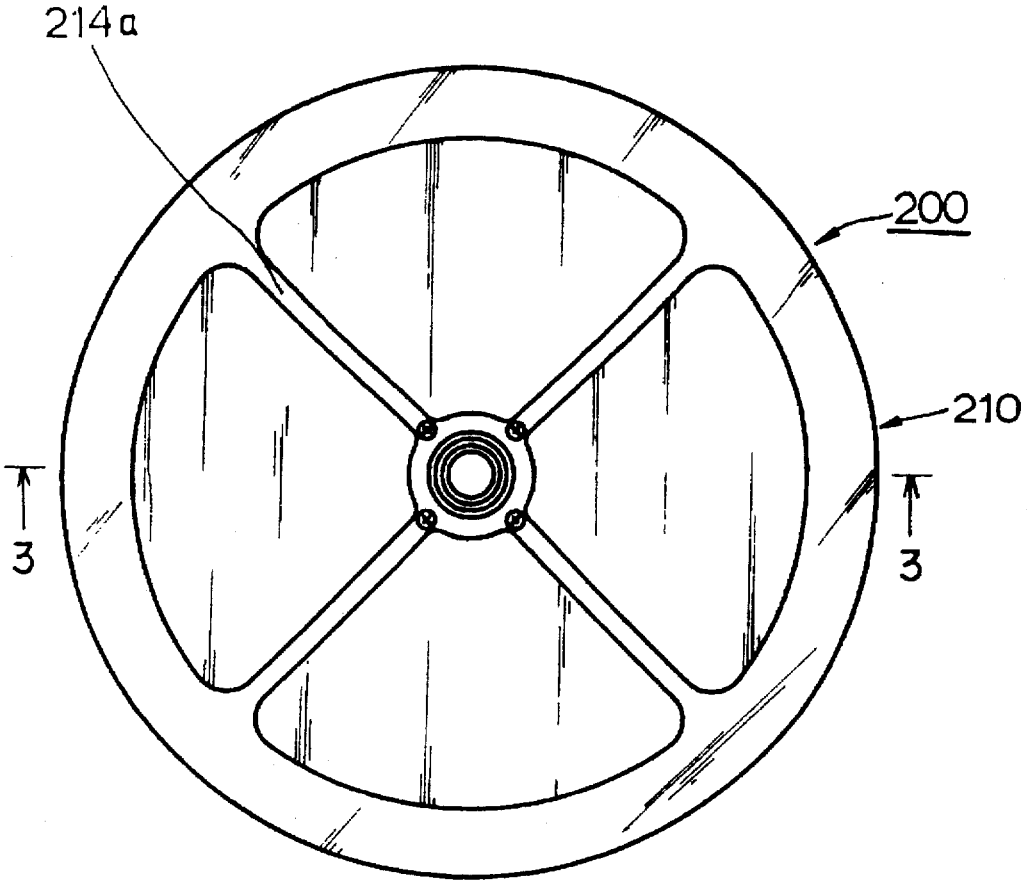
FIG. 1 is a top plan view for illustrating an agitator according to an embodiment of the present invention.

Referring to FIGS. 1 to 4, the inventive agitator 200 comprises a pulsator plate 210 fixedly attached to a central shaft 52 of a power transfer device 50 for being rotated in alternate directions on the bottom of a washing basket 60. An inertial rotating body 220 is movably mounted in the peripheral area of the pulsator plate 210 so as to be rotated by the inertia in alternate directions upon the rotation in alternate directions of the pulsator plate 210. A pulsator rod 230 centrally mounted on the pulsator plate 210 so as to reciprocate upwards and downwards to perturb the water flows, to prevent twisting or entangling of the clothes, and to beat the clothes upon the rotation in alternate directions of the pulsator plate 210, a compression spring 240 is mounted inside of the pulsator rod 230 so as to resiliently push the pulsator rod 230 upwards upon the rotation in one direction of the pulsator plate 210, and a plurality of pulling lines 250 for connecting the inertial rotating body 220 and the pulsator rod 230 to pull downwards the pulsator rod upon the rotation in the other direction of the pulsator plate 210.

The pulsator plate 210 comprises a first circular plate 211 fixed to the central shaft 52 of the power transfer device 50, a lower part 213 placed on the first circular plate 211, and an upper part 214 each firmly connected with the first circular plate 211 and the lower part 213 by means of a plurality of connecting screws 212. The lower part and the upper part 213 and 214 each have a central passage hole for passing the pulsator rod 230. A section of a guide groove 215 is formed along the perimeter of each part 213, 214, the groove sections facing each other to receive the inertial rotating body 220. Four stops 216 apertured are formed ninety degrees apart in the guide groove 215 to limit the rotational distance of the inertial rotating body 220 within a given range.

Extending radially within the agitar from the central passage holes to the groove 215 are line passage grooves 217 for passing the pulling lines 250. At both ends of each line passage groove 217 are provided a first and a second antiabrasive ring **218*a* and 218*b*. A plurality of radially extended blades 214*a* are projected on the upper part 214** to agitate the water flow as well as the clothes during a washing operation.

Figure 4:
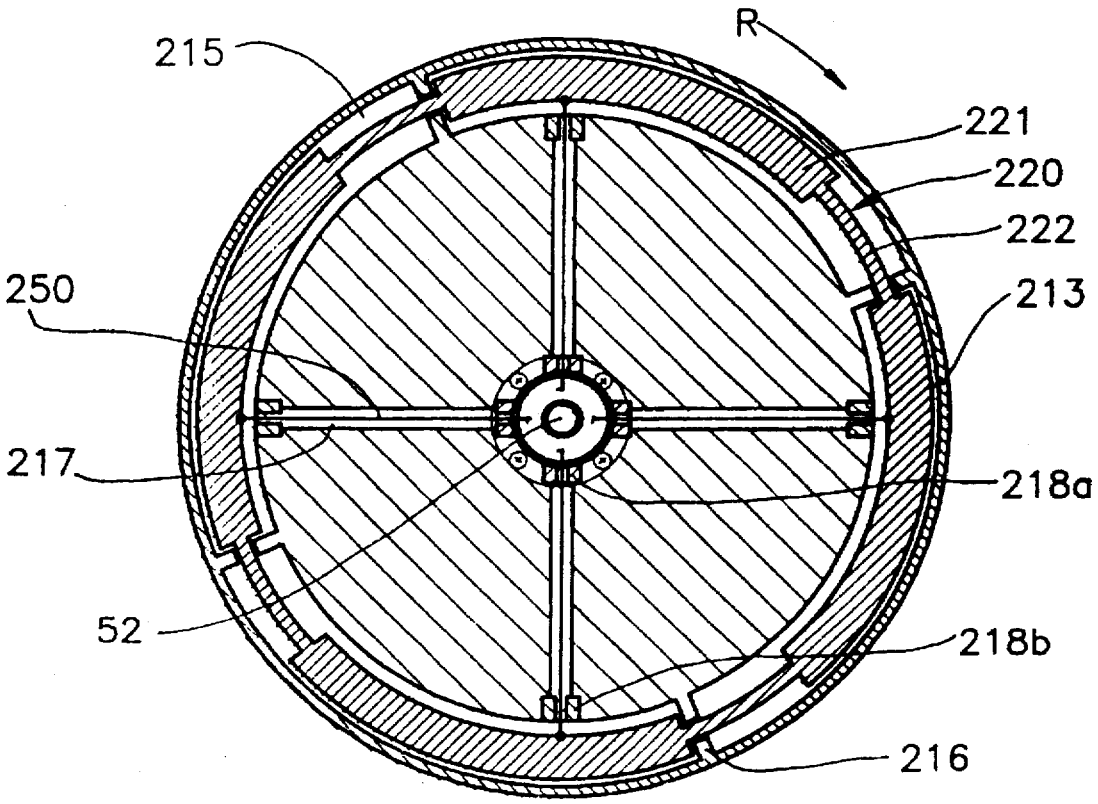
FIG. 4 is a cross sectional view taken along line 4—4 of FIG. 3.

The inertial rotating body 220 includes four large diameter portions 221 with four small diameter portions 222 each interposed between two adjacent ones of the large diameter portions, as shown in FIG. 4. Each of the large diameter portions 221 has a length smaller than that of the corresponding part of the guide groove 215. Each of the small diameter portions 222 slidably penetrates one of the stops 216 and has a length greater than that of the stop, so that the large diameter portions 221 are limited to a given range in their rotation.

Figure 2:
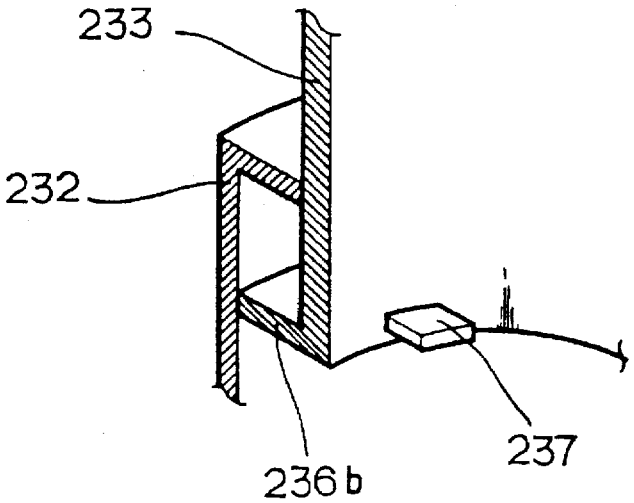
FIG. 2 is an enlarged cross sectional perspective view of the portion "B" of FIG. 3.

The pulsator rod 230 comprises first to fourth collapsible members 231, 232, 233 and 234 mounted on the first circular plate 211 in a telescoping manner before attaching the upper part 214, and a buoyant body 235 fixedly attached to the upper end of the fourth collapsible member 234. The first collapsible member 231 has a lower flange bent horizontally outwards and connected to the first circular plate 211 by means of a plurality of connecting screws 238. The second to the fourth collapsible member 232, 233 and 234 are sequentially inserted in the first collapsible member 231. As shown in FIG. 2, the second and third collapsible members 232 and 233 have respectively an upper horizontally inward flange and a lower horizontally outward flange 236*b* to prevent their separation upon expansion, and a plurality of protrusions 237 formed on the lower part of their inside walls to push down on the next higher one of the collapsible members upon collapsing. Likewise, the first collapsible member 231 cooperates with the second collapsible member 232 by means of a horizontal flange 236*a* and a plurality of protrusions 237, and the third collapsible member 233 cooperates with the fourth collapsible member 234 by means of a horizontal flange 236*c* and a plurality of protrusions 237. The first collapsible member 231 has four line passage holes 231*a* formed in its side wall respectively facing the four passage grooves 217 of the pulsator plate 210 to pass the pulling lines 250.

The compression spring 240 has the upper end contacting its ceiling of the fourth collapsible member 234 and its lower end contacting the upper surface of a second circular plate 241 attached to the central shaft 52. The force of the compression spring 240 is made weaker than the inertia of the inertial rotating body 220. The second circular plate 241 has a central threaded opening (not shown) to associate with the central shaft 52, and four peripheral guide holes 241*a* for guiding and changing the direction of the pulling lines 250 from the horizontal to the vertical. Of course, each of the four pulling lines 250 has a lower end attached to the corresponding large diameter portion 221 of the inertial rotating body 220 at a location closer to one of the stops 216 than to the other, and an upper end attached to an inside wall of the fourth collapsible member 234. In the drawings, the reference numeral 51 indicates the shaft of the washing basket, and numeral 61 references a water discharge aperture.

Figure 3:
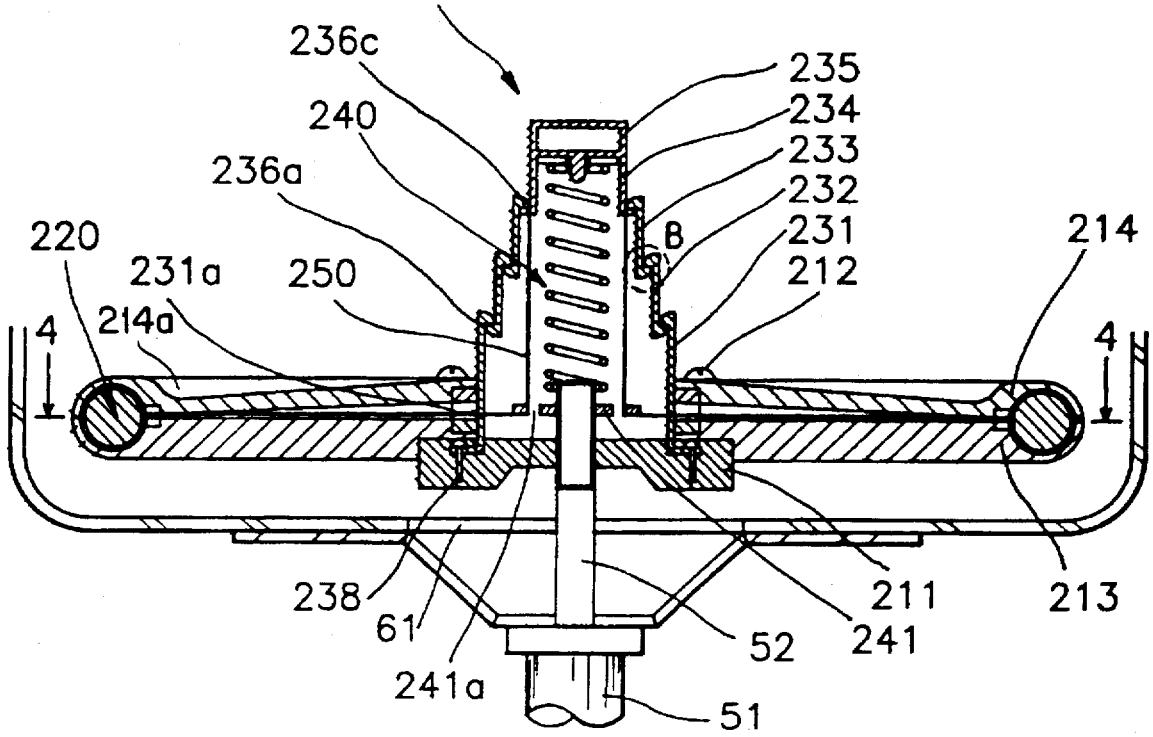
FIG. 3 is a cross sectional view taken along line 3—3 of FIG. 1 for illustrating a raised pulsator rod according to the present invention.

In operation, the pulsator plate 210 of the agitator 200 is rotated by means of the central shaft 52 in alternate directions, the agitation blades 214*a* radially formed on the upper plate 214 perturb the water in the washing basket 60 and stir the clothes. As shown in FIG. 4, when the pulsator plate 210 rotates in the direction of arrow R, one end of each large diameter portion 221 of the inertial rotating body 220 is contacted by a corresponding stop 216 so as to loosely maintain the lower end of the corresponding pulling line 250 at the passage groove 217 of the pulsator plate 210. Hence, the pulsator rod 230 mounted centrally through the pulsator plate 210 rises, as shown in FIG. 3, spreading the second to fourth collapsible members 232, 233 and 234 upward from the first collapsible member 231 by the resilient force of the compression spring 240, so that the buoyant body 235 mounted on the fourth collapsible member 234 strikes the clothes and perturbs the water flows.

When the second to the fourth collapsible member 232, 233 and 234 are expanded, the pulling lines 250 are guided through the guide holes 241*a* of the second circular plate 241 changing the direction from the horizontal to the vertical and tensioned since the upper end is connected to the horizontal flange 236*c* of the fourth collapsible member 234.

Figure 5:
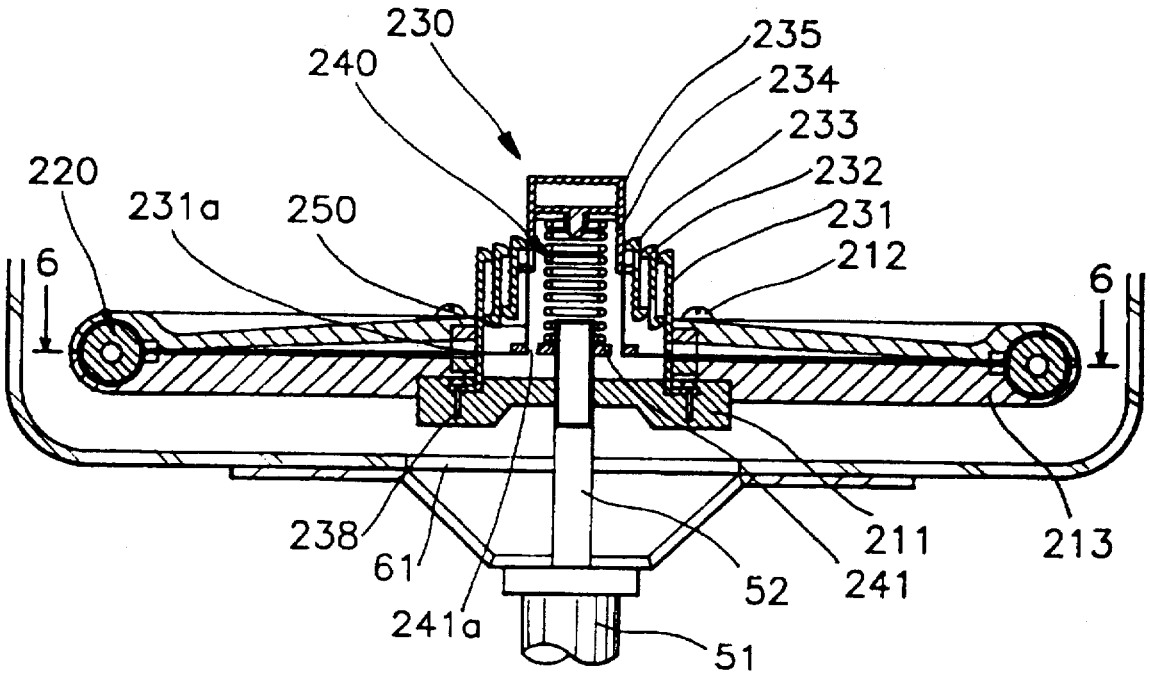
FIG. 5 is a cross sectional view taken along line 3—3 of FIG. 1 for illustrating a lowered pulsator rod according to the present invention.
Figure 6:
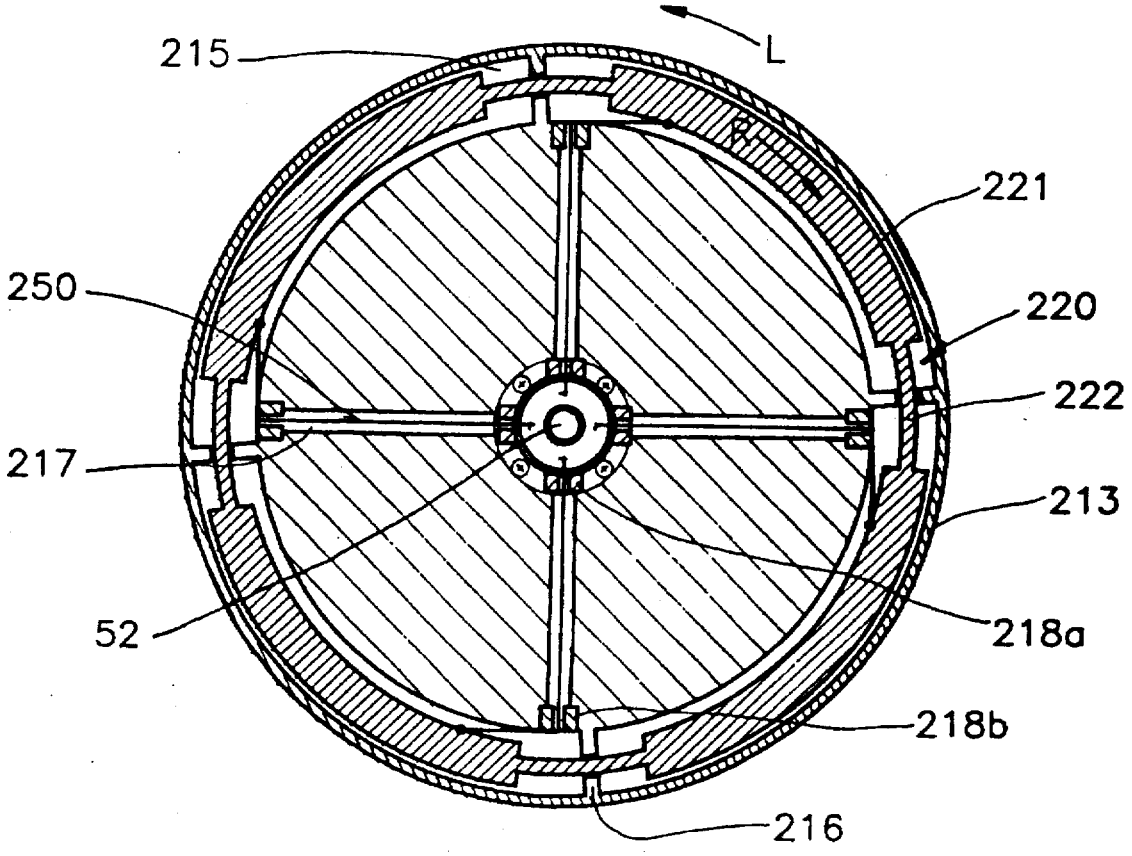
FIG. 6 is a cross sectional view taken along line 5—5 of FIG. 5.
Figure 7:
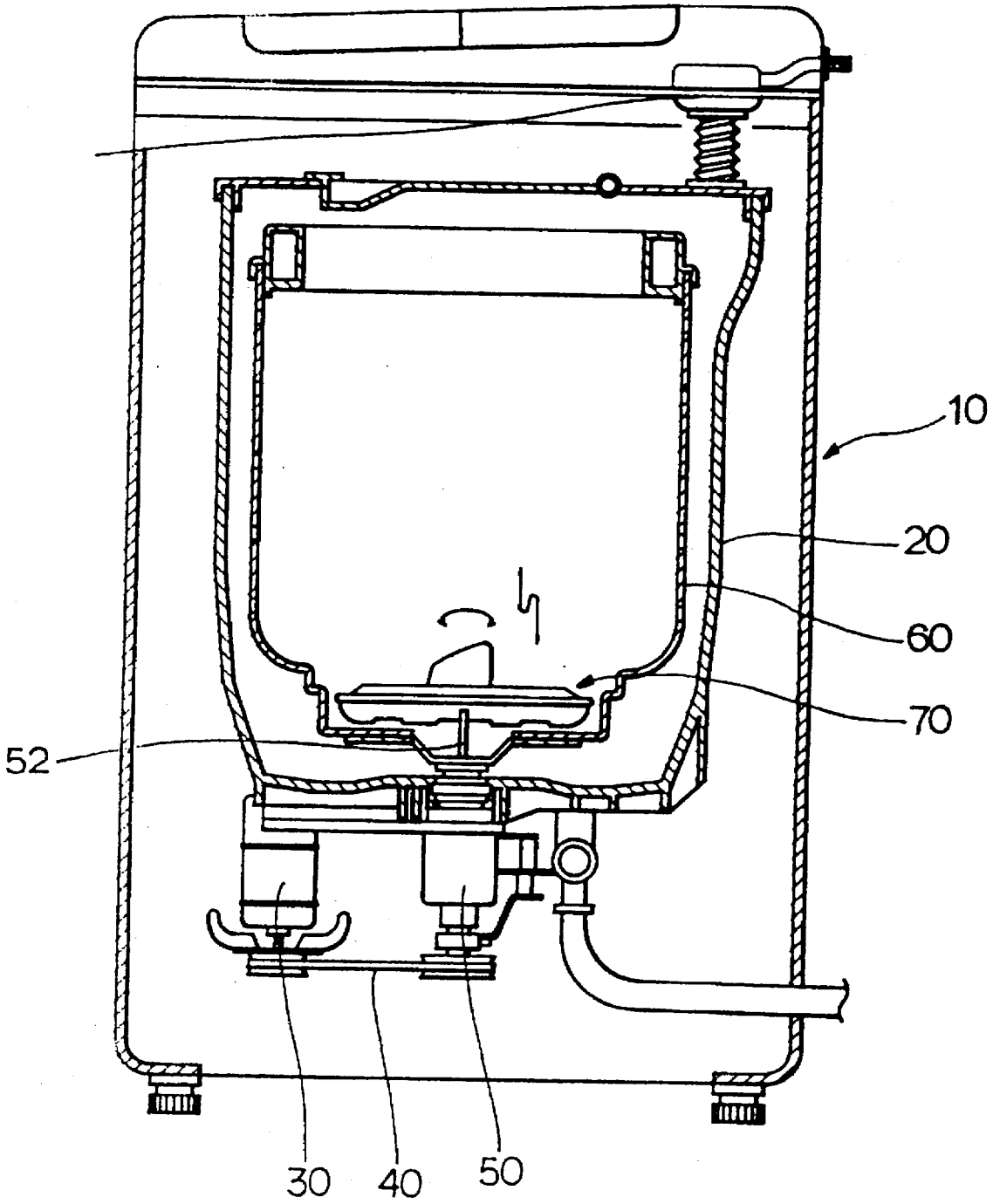
FIG. 7 (PRIOR ART)
FIG. 7 is a vertical sectional view for illustrating a conventional clothes washing machine.
Figure 8:
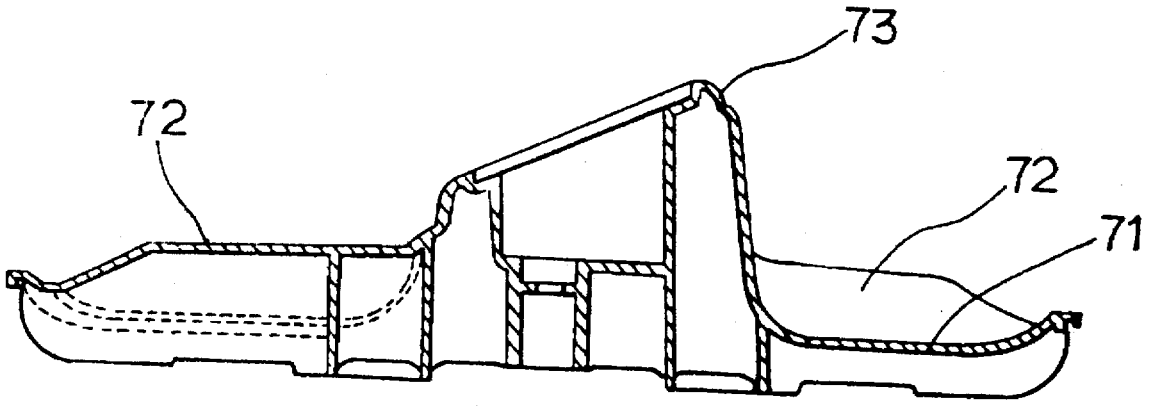
FIG. 8 (PRIOR ART)
FIG. 8 is a cross sectional view of a conventional agitator of FIG. 7.

On the contrary, when the pulsator plate 210 is rotated in the opposite direction as indicated by arrow L in FIG. 6, the inertial rotating body 220 of the pulsator plate 210 keeps on rotating in the previous direction as indicated by arrow R, so that the lower ends of the pulling lines 250 are drawn away from the passage grooves 217. Hence, as shown in FIG. 5, the upper ends of the pulling lines 250 pull downwards the fourth collapsible member 234 while compressing the compression spring 240 mounted between the fourth collapsible member 234 and the second circular plate 241, so that the previously expanded second to fourth collapsible members 232, 233 and 234 are pulled down and collapsed into the first collapsible member 231. Thereafter, when the central shaft 52 is rotated in the direction R, the pulsator rod 230 is raised as shown in FIG. 3.

As described above, the inventive agitator is structured so that, as the pulsator plate is rotated in alternate directions, the pulsator rod reciprocates upwards and downwards in telescoping fashion by the cooperation of the inertial rotating body, the compression spring and the pulling lines, thus perturbing the water flows, and stirring and beating the clothes. Hence, the clothes washing efficiency is considerably improved.

What is claimed is:

1. A clothes washing machine comprising:

a water container;

a washing basket rotatably mounted in said water container;

an agitator disposed at a bottom of said washing basket for rotation in opposite directions about an axis, the agitator including a pulsator plate rotatable in alternating directions and including generally radially extending agitating blades, and a pulsator rod arranged to be displaced in upward and downward directions relative to the pulsator plate at a center thereof; a drive mechanism for rotating the pulsator plate in opposite directions;

an inertia body mounted on the pulsator plate, the pulsator plate being rotatable relative to the inertia body;

a coupling connecting the inertia body to the pulsator rod for displacing the pulsator rod in one of the upward and downward directions in response to rotation of the pulsator plate relative to the inertia body in one direction of rotation; and a spring for displacing the pulsator rod in the other of the upward and downward directions during rotation of the pulsator plate in the opposite direction.

2. The clothes washing machine according to claim 1 wherein the coupling displaces the pulsator rod in the downward direction, and the spring displaces the pulsator rod in the upward direction.

3. The clothes washing machine according to claim 1 wherein the inertia body is mounted on the pulsator plate for rotation relative thereto about the axis, the coupling including at least one cable.

4. The clothes washing machine according to claim 3 wherein the inertia member is situated adjacent an outer periphery of the pulsator plate.

5. The clothes washing machine according to claim 3 wherein the inertia body is disposed in a groove in the inertia plate, the groove being closed at opposite circumferential ends.

6. The clothes washing machine according to claim 5 wherein the groove is divided into a plurality of circumferentially spaced portions by stop walls; the inertia body being divided into a plurality of circumferentially spaced portions interconnected by narrower elements of the body which project through respective openings in the stop wall.

7. The clothes washing machine according to claim 1 wherein the pulsator rod includes a plurality of telescoping members.

8. The clothes washing machine according to claim 1 wherein the pulsator plate includes a center hole disposed adjacent a bottom of the washing basket, the pulsator rod projecting through the opening.

* * * * *